United States Patent [19]

Paray

[11] 4,406,205

[45] Sep. 27, 1983

[54] MUSICAL INSTRUMENT LID SAFETY LOCK

[75] Inventor: Steven C. Paray, Hoopeston, Ill.

[73] Assignee: CBS Inc., New York, N.Y.

[21] Appl. No.: 336,748

[22] Filed: Jan. 4, 1982

[51] Int. Cl.[3] ..... G10C 3/02

[52] U.S. Cl. ..... 84/183; 84/177; 84/DIG. 17

[58] Field of Search ..... 84/177-180, 84/183, 352, DIG. 3, DIG. 17

[56] References Cited

U.S. PATENT DOCUMENTS

| | | | |
|---|---|---|---|
| 426,268 | 4/1890 | Guild | 84/180 |
| 1,014,159 | 1/1912 | Logan | 84/177 |
| 4,040,335 | 8/1977 | Oliver et al. | 84/183 |
| 4,334,453 | 6/1982 | Kumano | 84/177 |

*Primary Examiner*—Lawrence R. Franklin
*Attorney, Agent, or Firm*—Spencer E. Olson

[57] ABSTRACT

A mechanism is disclosed for providing safe locking of the lid of an electronic musical instrument.

6 Claims, 3 Drawing Figures

MUSICAL INSTRUMENT LID SAFETY LOCK

BACKGROUND OF THE INVENTION

This invention relates to electronic musical instruments and, more particularly, to a safety locking improvement for an electronic musical instrument.

In an electronic musical instrument, for example, an electronic organ, it is important to provide protection against unrestricted immediate access by unskilled or unauthorized persons to the interior of the instrument which contains the electronics thereof. In addition to the possibility of electric shock, an unskilled or unauthorized person could unwittingly cause significant damage to delicate and complex electronic equipment. Notwithstanding these considerations, however, the mechanism for securing the lid which provides access to the interior of the musical instrument should preferably be relatively inexpensive, sturdy, and provide easy and quick access to a person who is familiar with the locking mechanism, such as an authorized service person. It is an object of the present invention to provide safety locking for a musical instrument which meets these criteria.

SUMMARY OF INVENTION

The present invention is intended for use in conjunction with a musical keyboard instrument that includes: a housing having a bottom panel, at least one keyboard assembly pivotally mounted to said housing, a lid pivotally mounted to a rear portion of the housing and being pivotable upward to expose the interior of the musical instrument, and a first bracket mounted on the underside of the lid and extending angularly downward from the lid toward the keyboard assembly, the first bracket having a flange extending substantially orthogonally therefrom toward the keyboard assembly. The invention is an improved combination for providing safe locking of the lid to prevent immediate access to the interior of the musical instrument. In accordance with the invention, a second bracket is mounted on the keyboard assembly and extends angularly toward the first bracket. The second bracket is positioned and oriented to engage and hold the flange of the first bracket when the keyboard assembly is in its lowermost pivot position, and is disengageable from the flange when the keyboard assembly is pivoted upwardly and the lid is lifted. An elongated removable fastener extends through the bottom panel of the musical instrument, and is adapted to engage the keyboard assembly and the bottom panel so as to secure the keyboard assembly in its lowermost pivot position.

In the preferred embodiment of the invention, the first bracket has a foot at the end thereof, the foot being oriented to engage the surface of the keyboard assembly when the second bracket engages the flange of the first bracket. In this embodiment, the first bracket also has a further flange located between the foot and the first-mentioned flange of the first bracket, the further flange also being oriented to engage the keyboard assembly when the second bracket engages the first-mentioned flange of the first bracket.

Further features and advantages of the invention will become more readily apparent from the following detailed description when taken in conjunction with the accompanying drawings.

DESCRIPTION OF THE PREFERRED EMBODIMENT

Figure 1:
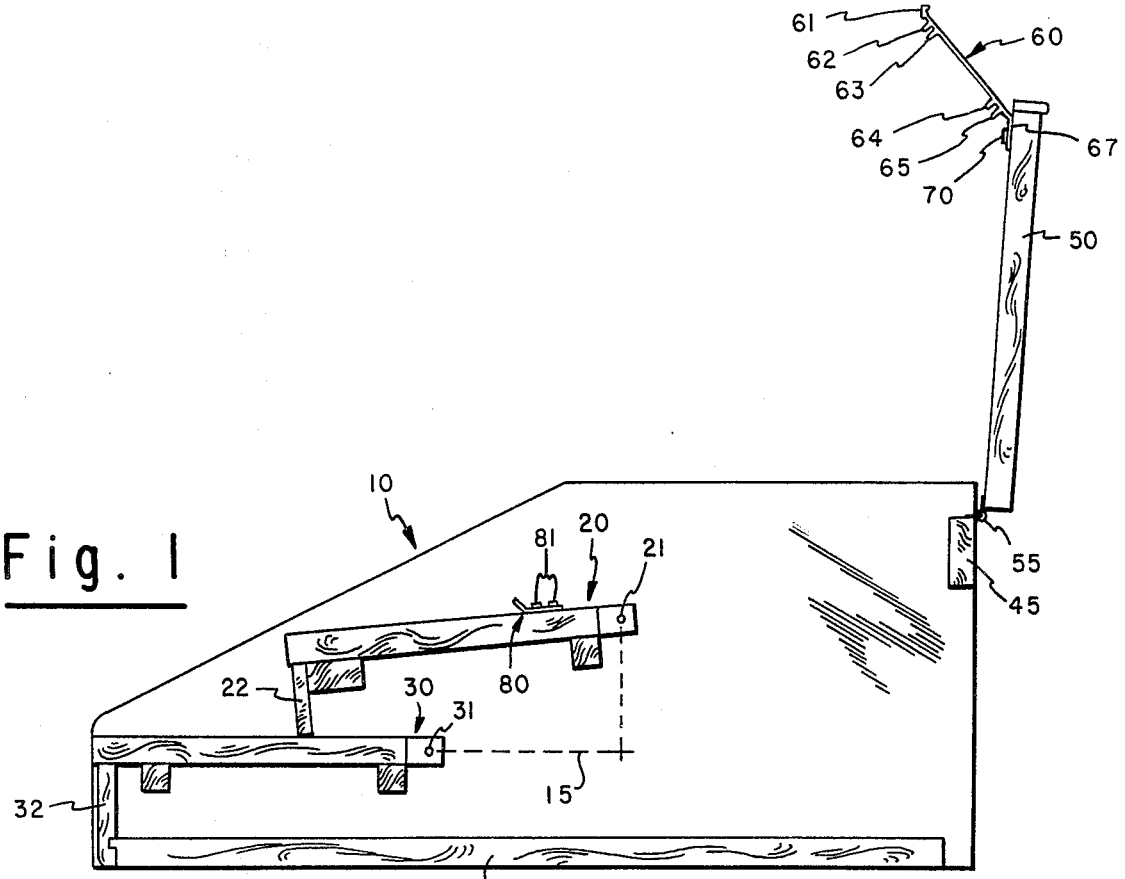
FIG. 1 is a side cross-sectional view of a musical instrument that includes the invention, the lid of the musical instrument being in its uppermost position.
Figure 2:
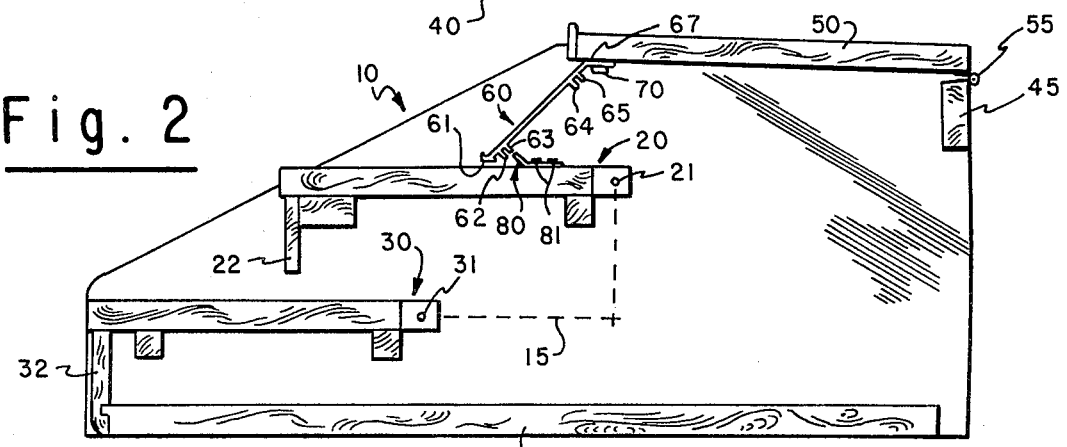
FIG. 2 is the musical instrument of FIG. 1 with the locking feature thereof about to engage or disengage.
Figure 3:
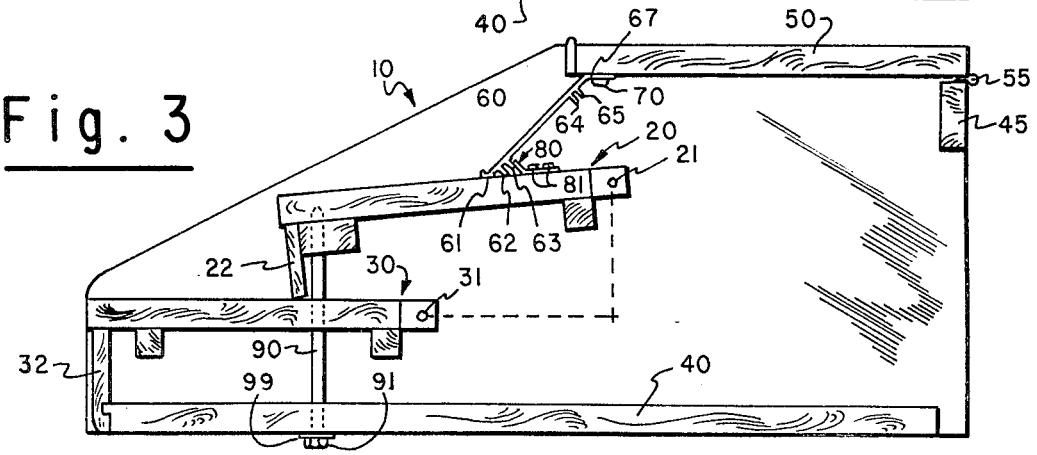
FIG. 3 is the musical instrument of FIG. 1 with the lid in the locked position.

Referring to FIGS. 1–3 there is shown a simplified view of an electronic musical instrument 10 which includes a solo keyboard assembly 20 and an accompaniment keyboard assembly 30 that are pivotally mounted, on axes 21 and 31, respectively, to the housing of the musical instrument. (For ease of illustration, the housing and main structural frame of the musical instrument, other than the body outline shown and the bottom panel 40, is represented by the dashed lines 15.) The pivotal mounting of keyboard assemblies is conventional in electronic musical keyboard instruments to allow access for servicing of keyswitches. The accompaniment keyboard assembly 30 is illustrated as having a vertical front panel 32 which engages the bottom panel 40 of the musical instrument housing. Typically, the legs or other supportive structure (not shown) of the musical instrument are located below the bottom panel 40. The solo keyboard assembly 20 has a front vertical panel 22 which, at the rest position of the solo keyboard assembly 20, is supported on the accompaniment keyboard assembly 30, as shown in FIGS. 1 and 3.

The musical instrument 10 conventionally has a lid 50 which is pivotally mounted to the rear panel 45 of the instrument at pivot axis 55 and opens, as shown in FIG. 1, to expose the interior of the musical instrument. A bracket 60 is mounted at one end 67 thereof to the lid 50 by mounting screws 70, one of which is visible in the figures. The bracket 60 extends across the front of the musical instrument (i.e. into the plane of the paper in the figures), and can serve as support for the front control panel of the musical instrument, upon which the stops and effects control switches and indicators are mounted, as disclosed in copending U.S. application Ser. No. 111,405, assigned to the same assignee as the present application. The bracket 60 extends angularly from the end 67 thereof toward an opposing free end that terminates in an angularly oriented foot 61 that is adapted to engage the top surface of the solo keyboard assembly, as shown in FIG. 3. Extending from the underside of the bracket 60 are flanges 62, 63, 64 and 65 which are formed integrally with the bracket, for example during the molding of the metal thereof. Some of these flanges may typically be used to provide support for or define the space for circuitry or hardware relating to the front control panel.

In accordance with an aspect of the improvement of the present invention, another bracket 80 is mounted generally toward the rear on the top surface of the solo keyboard assembly 20. The base of the bracket 80 is mounted, in the present embodiment, by screws 81. (A second bracket 80, not visible in the figures, can be aligned with the illustrated bracket, in the plane of the paper, and operates in the same manner as the illustrated bracket.) The bracket 80 extends angularly from the base thereof toward the bracket 60, as seen in FIG. 2. The bracket 80 is positioned and oriented to engage and hold the flange 63 of bracket 60 when the solo keyboard assembly 20 is in its lowermost pivot position, as shown in FIG. 3, and to be disengageable from said flange 63 when the solo keyboard assembly 20 is pivoted upwardly and the lid 50 is lifted, as illustrated in FIGS. 2 and 1.

An elongated removable fastener, which comprises a lag screw 90 in the illustrated embodiment, extends through the bottom panel 40 of the musical instrument 10 and is adapted to engage the bottom of the solo keyboard assembly 20 to secure the solo keyboard assembly in its lowermost pivot position. The lag screw 90 has a head 91 which abuts the underside of the bottom panel 40 (via washer 99 in the illustration) and is provided with screw threading at its opposing end that engages a threaded hole in the bottom of the solo keyboard assembly 20. The lag screw may bypass the side of accompaniment keyboard 30 or pass through an aperture therein.

In operation, assume that the musical instrument is in the position shown in FIG. 3; i.e., with the solo keyboard assembly 20 in its normal rest or "playing" position, the flange 63 of bracket 60 secured under the bracket 80 and the foot 61 and flange 62 of bracket 60 engaging the upper surface of solo keyboard assembly 20. The lag screw 90 prevents the solo keyboard 20 from being pivoted upward, so the solo keyboard and the lid 50 are both locked in place.

To open the lid 50 it is necessary to first remove the lag screw 90 which allows the solo keyboard assembly 20 to be pivoted upward (e.g. FIG. 2). At the same time that the solo keyboard assembly 20 is pivoted and held upward, such action allowing disengagement of flange 63 from bracket 60, the lid 50 is lifted to an open position. The solo keyboard assembly can then be released to return to its normal rest position (e.g. FIG. 1) while the musical instrument is repaired or maintained. To return the lid to a locked position, the solo keyboard assembly is tilted upward and the lid is lowered (e.g. FIG. 2) until the bracket 80 can engage the flange 63. The solo keyboard assembly 20 is then released, to again attain the position shown in FIG. 3. The lag screw 90 is then used again to secure the solo keyboard assembly 20 in place.

I claim:

1. For use in conjunction with a musical keyboard instrument that includes a housing having a bottom panel; at least one keyboard assembly pivotally mounted to said housing; a lid pivotally mounted to a rear portion of said housing and being pivotable upward to expose the interior of said musical instrument; and a first bracket mounted on the underside of said lid and extending angularly downwardly from said lid toward said keyboard assembly, said first bracket having a flange extending substantially orthogonally therefrom toward said keyboard assembly; an improved combination for providing safe locking of said lid to prevent immediate access to the interior of said musical instrument, comprising, in combination:

a second bracket mounted on said keyboard assembly and extending angularly toward said first bracket, said second bracket being positioned and oriented to engage and hold the flange of said first bracket when said keyboard assembly is in its lowermost pivot position and to be disengagable from said flange when said keyboard assembly is pivoted upwardly and said lid is lifted; and an elongated removable fastener extending through the bottom panel of said musical instrument and being adapted to engage said keyboard assembly and said bottom panel so as to secure said keyboard assembly in its lowermost pivot position.

2. The combination as defined by claim 1 wherein said elongated removable fastener comprises a lag screw having a head engaging said bottom panel and threading that engages said keyboard assembly.

3. The combination as defined by claim 2, wherein said first bracket has a foot at the end thereof oriented to engage the surface of said keyboard assembly when said second bracket engages the flange of said first bracket.

4. The combination as defined by claim 3, wherein said first bracket also has a further flange located between said foot and the first-mentioned flange of said first bracket, said further flange also being oriented to engage said keyboard assembly when said second bracket engages said first-mentioned flange of said first bracket.

5. The combination as defined by claim 1, wherein said first bracket has a foot at the end thereof oriented to engage the surface of said keyboard assembly when said second bracket engages the flange of said first bracket.

6. The combination as defined by claim 5, wherein said first bracket also has a further flange located between said foot and the first-mentioned flange of said first bracket, said further flange also being oriented to engage said keyboard assembly when said second bracket engages said first-mentioned flange of said first bracket.

* * * * *